United States Patent [19]

Yamana et al.

[11] 4,107,911

[45] Aug. 22, 1978

[54] PNEUMATIC SPINNING APPARATUS

[75] Inventors: Makoto Yamana, Joyoshi; Nobunori Kubota, Nagaokakyoshi, both of Japan

[73] Assignee: Murata Kikai Kabushiki Kaisha, Kyotoshi, Japan

[21] Appl. No.: 806,486

[22] Filed: Jun. 14, 1977

[30] Foreign Application Priority Data

| | | | |
|---|---|---|---|
| Jun. 18, 1976 | [JP] | Japan | 51-80859[U] |
| Jun. 23, 1976 | [JP] | Japan | 51-83069[U] |
| Jan. 8, 1977 | [JP] | Japan | 52-1142[U] |

[51] Int. Cl.[2] ..... D01H 11/00; D02G 1/16

[52] U.S. Cl. ..... 57/56; 57/34 B

[58] Field of Search ..... 57/1 R, 34 R, 34 B, 57/56, 58.89, 157 F

[56] References Cited

U.S. PATENT DOCUMENTS

| | | | |
|---|---|---|---|
| 3,253,313 | 5/1966 | Head | 57/157 F |
| 3,445,995 | 5/1969 | Bell et al. | 57/34 B X |
| 3,453,709 | 7/1969 | Dyer | 57/34 B X |
| 3,559,965 | 2/1971 | Ishida et al. | 57/34 HS X |
| 3,623,195 | 11/1971 | Nechvatal et al. | 57/34 B X |
| 3,822,543 | 7/1974 | Edagawa et al. | 57/34 B X |

*Primary Examiner*—Donald Watkins

*Attorney, Agent, or Firm*—Whittemore, Hulbert & Belknap

[57] ABSTRACT

A cover is disposed to cover the entire spinning nozzle zone of a pneumatic spinning apparatus. This cover includes an air suction tube disposed in the interior of the cover, and this air suction tube has the functions of sucking and removing fly wastes generated in the cover and making a contribution to discharge of compressed air jetted from spinning nozzles.

7 Claims, 7 Drawing Figures

PNEUMATIC SPINNING APPARATUS

BACKGROUND OF THE INVENTION

A so-called pneumatic spinning process which comprises passing a sliver through an air-jetting nozzle to impart false-twist and to directly spin the sliver by a swirling stream of jetted air is known from U.S. Pat. No. 3,079,746, U.S. Pat. No. 3,978,648, U.S. Patent applicaton Ser. No. 682,272 filed May 3, 1976, and U.S. Patent application Ser. No. 730,349 filed Oct. 7, 1976.

In this pneumatic spinning process, large quantities of fly wastes are scattered from the air jetting nozzle, and further, fly wastes tend to be generated from resulting spun yarns.

When fly wastes are deposited in the vicinity of the spinning nozzle zone, the capacity of the nozzle is reduced and the yarn quality is degraded. Moreover, scattered fly wastes worsen the working environment.

SUMMARY OF THE INVENTION

In accordance with the first aspect of the present invention, in a pneumatic spinning apparatus, a cover is disposed to cover the entire of the spinning nozzle zone, and an air suction tube is disposed in this cover.

Fly wastes generated in the spinning nozzle zone are sucked and discharged into the air suction tube, and a negative pressure caused in the interior of the cover promotes discharge of air to enhance the capacity of the spinning nozzle and makes a contribution to production of high quality yarns.

In accordance with the second aspect of the present invention, a yarn spun from a spinning nozzle may be bent and then, the spun yarn is withdrawn from the above-mentioned cover.

In spun yarns prepared according to the conventional pneumatic spinning process, there is observed a tendency that fly wastes are readily generated, and when such spun yarns are wound in the as-spun state, large quantities of fly wastes are often formed in the yarn guide portion and winding portion.

However, this defect can be effectively eliminated when spun yarns are bent according to the present invention. More specifically, monofilaments which are readily separated from the resulting spun yarn are positively isolated from the yarn at the bent portion and sucked and discharged through the air suction tube. Therefore, formation of fly wastes in the so treated yarn can be remarkably reduced.

DETAILED DESCRIPTION OF THE PREFERRED EMBODIMENTS

The present invention will now be described in detail by reference to embodiments illustrated in the accompanying drawings.

Figure 1:
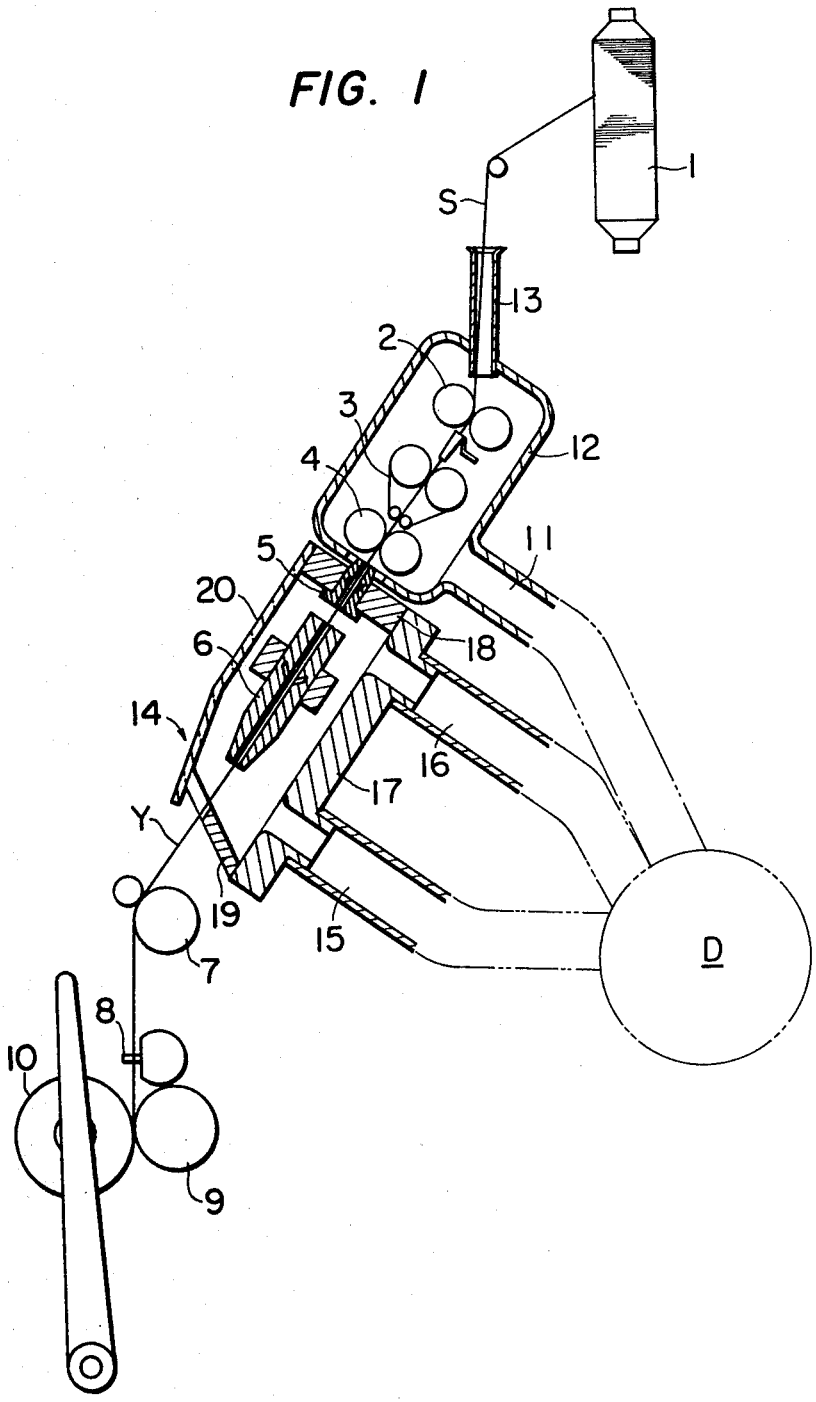
FIG. 1 is a partially sectional view illustrating the entire structure of the apparatus of the present invention.

Referring now to FIG. 1, a sliver S taken out from a bobbin 1 is drawn by a draft roller zone comprising back rollers 2, an apron 3 and front rollers 4, and it is then passed through spinning nozzles 5 and 6, whereby a yarn Y is formed by spinning. The spun yarn Y is traversed by a traverse guide 8 while it is being taken out by nip rollers 7, and it is wound on a package 10 being rotated by a driving roller 9.

The entire structure of the draft roller zone is covered by a draft roller cover 12 communicated with an air suction tube 11, and the sliver S is introduced into the draft roller cover 12 through a pipe 13.

The spinning nozzles 5 and 6 are covered by a cover 14 having the four sides closed, and air suction tubes 15 and 16 are connected to the interior of the cover 14.

In the pneumatic spinning process, fly wastes are generated in major parts of the draft roller zone and the spinning nozzle zone, but the majority of such fly wastes coming out of the spinning apparatus can be sucked and discharged by provision of the draft roller cover 12 and the nozzle cover 14. Each suction tube is connected to a duct D penetrating a machine stand, and sucked fly wastes are collected in a waste-storing box disposed at the end of the duct D and they can be utilized for production of non-woven fabrics and quilt fillings.

The nozzle cover 14 has the four sides thereof closed by a body member 17, a nozzle holder 18 for the first nozzle 5, a yarn guide plate 19 and a lid 20, and the air suction tubes 15 and 16 are connected to the body member 17 and nozzle holders for the spinning nozzles 5 and 6 are supported on the body member 17.

Figure 2:
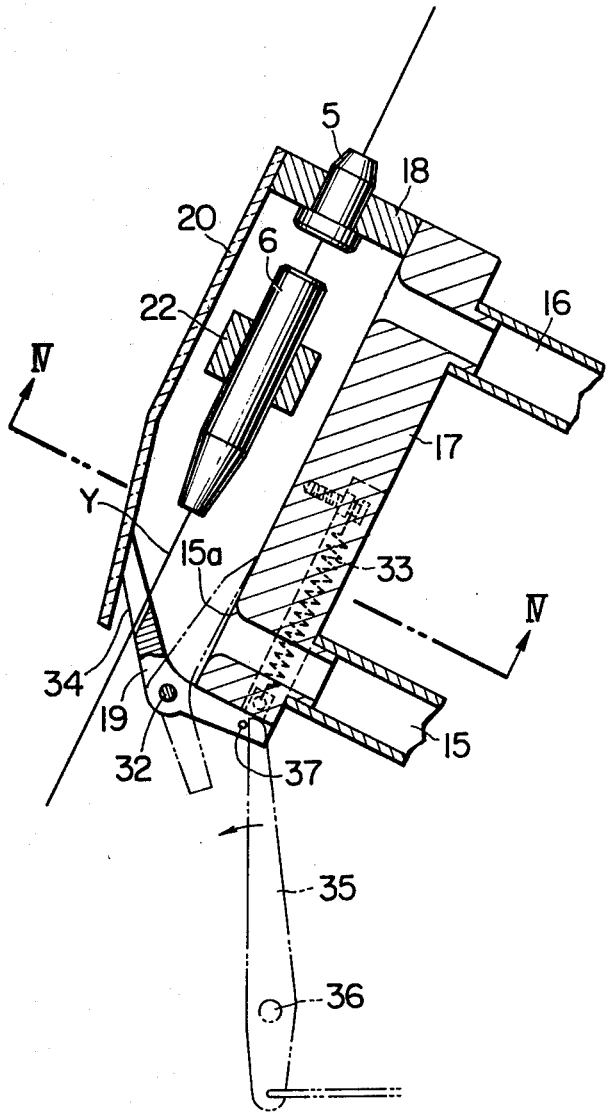
FIG. 2 is a sectional side view illustrating one embodiment of the nozzle cover of the present invention.
Figure 3:
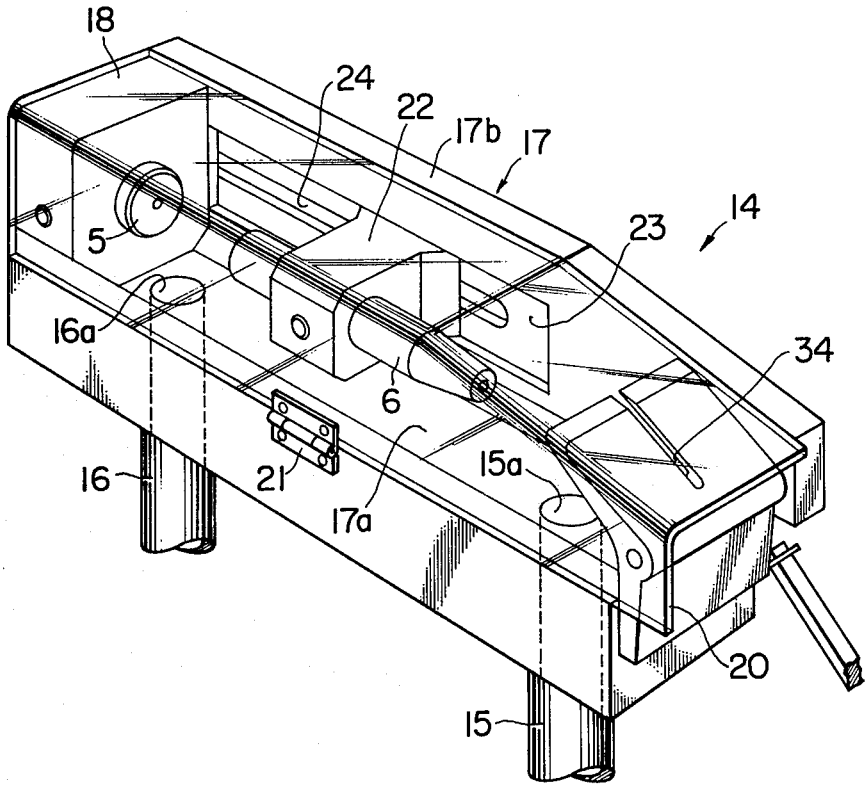
FIG. 3 is a perspective view illustrating the nozzle cover shown in FIG. 2.
Figure 4:
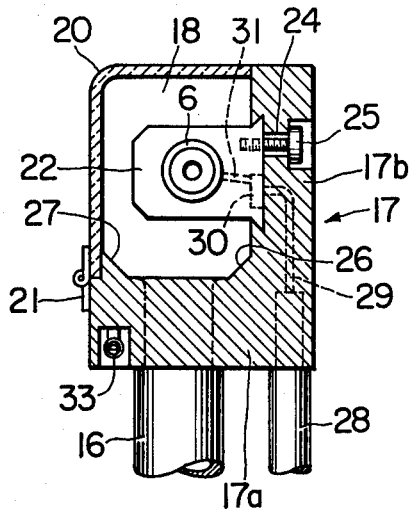
FIG. 4 is a view showing the section taken along the line IV—IV in FIG. 2.

One embodiment of this nozzle cover 14 is illustrated in FIGS. 2 to 4.

Each of the body member 17 and lid 20 is formed to have an L-shaped section, and the lid 20 is transparent and is supported on a bottom wall **17*a* of the body member 17 through a hinge 21 so that the lid 20 can be freely opened and closed. A nozzle holder 18 for the first nozzle 5 and a nozzle holder 22 for the second nozzle 6 are movably fitted in a dovetail groove 23 formed on a side wall 17*b* of the body member 17. A bolt 25 is screwed into the nozzle holders 18 and 22 through a long hole 24 formed in the dovetail groove 23, whereby both the nozzle holders 18 and 22 are fixed to the side wall 17*b***.

The nozzle holder 18 is disposed to close the rear end of the nozzle cover 14, but the nozzle holder 22 provides spaces in three sides other than the side of the side wall **17*b*. Openings 15*a* and 16*a* of the suction tubes 15 and 16 are formed on the bottom wall 17*a*. In general, larger quantities of fly wastes are often deposited on the lower side of the nozzle cover, but when spaces are formed between the nozzle holder 22 and the bottom wall 17*a* as pointed out above, since there is no hindrance disturbing the air stream below the nozzle holder but the openings 15*a* and 16*a* of the air suction tubes 15 and 16 are formed on the bottom wall, deposition of fly wastes on the lower side of the nozzle cover can be substantially prevented. If inclined faces 26 and 27 are formed at the corners of the bottom wall 17*a***, prevention of accumulation of fly wastes on the lower side of the nozzle cover can be further enhanced.

Reference numeral 28 represents a compressed air feed tube 28, and compressed air is fed to the nozzles from a conduit 29 in the body through a long tube 30 and a conduit 31 of the nozzle holder.

The yarn guide plate 19 is disposed so that it can turn with a pin 32 being as a fulcrum, and it is always urged by a spring 33 so that the top end of the guide plate 19 is caused to fall in contact with the lower face of the lid 20 as indicated by solid lines in FIGS. 2 and 3 to close the cover.

The yarn Y is taken out of the cover through a slit 34. When the yarn is broken, the yarn breakage is detected by a yarn breakage sensing feeler (not shown), and by the operation of this feeler, the winding drum is stopped and feeding of the sliver is stopped while fly wastes are discharged in the air suction tube 15. Further, co-operatively with positioning of a yarn piecing-up device (not shown) at a predetermined point, a lever 35 is turned in a direction of arrow A with a shaft 36 being as the center, and the top end of the lever 35 presses a pin 37 of the yarn guide plate 19 to turn the yarn guide plate 19 in the clockwise direction with the shaft or pin 32 being as the center against the spring 33 to a position indicated by a dotted line (shown in FIG. 3) so that the yarn guide plate 19 covers the opening 15*a* of the air suction tube 15. Accordingly, when the yarn guide plate is located at this position indicated by the dotted line, a stream of air jetted from the second nozzle 6 is not directed toward the air suction tube 15 but is straightly advanced.

When feeding of the sliver is initiated again in the above state, the spun yarn is straightly advanced by the straightly advanced stream of air jetted from the second nozzle 6 and is forwarded to the nip roller 7. The yarn held and supported by the nip roller 7 is joined with the yarn on the package 10 by the yarn piecing up device, whereby the normal spinning and winding state is restored. Then, the lever 35 is returned to the original position on completion of the yarn piecing up operation, and simultaneously, the yarn guide plate 19 is returned to the original position by the spring 33. Since a slit 34 is formed on the yarn guide plate 19, the plate 19 is returned to the original position without standing in the way of the running yarn, and air jetted from the second nozzle 6 is flown into the air suction tube 15 again.

As will be apparent from the foregoing illustration, according to the present invention, freely opening and closing shutter means is disposed on the yarn discharge side end of the nozzle box, and when yarn breakages take place, the shutter means is turned to a position closing the opening of the air suction tube, whereby the yarn running passage is broadened and the stream of air jetted from the nozzle is guided to the side of the nip roller. Accordingly, the yarn end can be automatically advanced to the nip roller very smoothly while the lid 20 is kept in the closed state.

Figure 5:
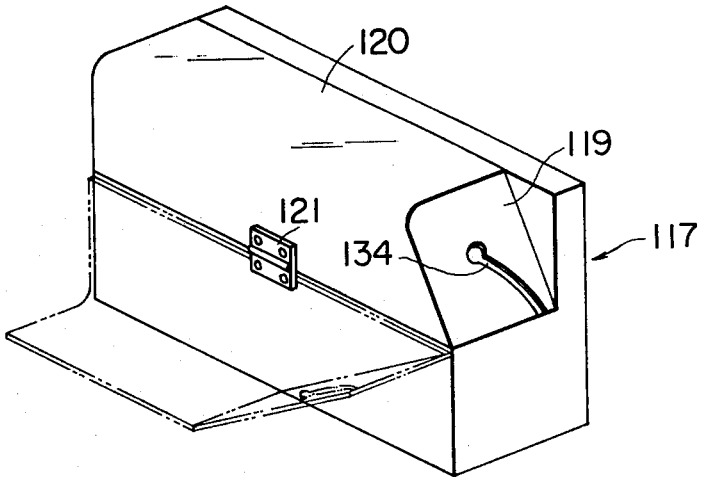
FIG. 5 is a perspective view illustrating another embodiment of the nozzle cover of the present invention.

FIG. 5 illustrates another embodiment of the nozzle cover of the present invention. In this embodiment, a yarn guide plate 119 is formed integrally with a lid 120, and a yarn-passing slit 134 is formed to have an arc-like shape, the center of which is in agreement with the center of a hinge 121. In this embodiment, on the yarn piecing up operation, the yarn end is taken out while the lid 120 is opened as indicated by a dotted line.

In the foregoing two embodiments, there is sometime brought about an undesirable phenomenon that fly wastes are scattered while being dragged by the running yarn and they pass through slits 34 and 134 together with the yarn and are caused to escape outside from the cover.

Figure 6:
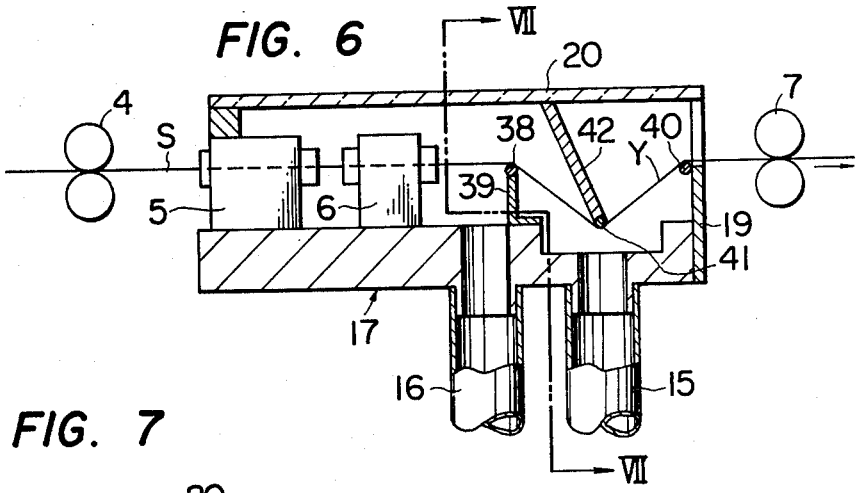
FIG. 6 is a sectional side view illustrating still another embodiment of the nozzle cover of the present invention.
Figure 7:
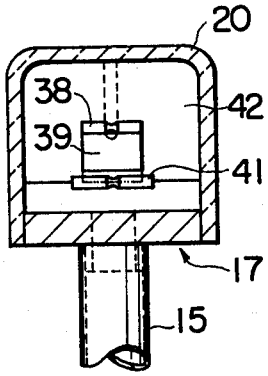
FIG. 7 is a view showing the section taken along the line VII—VII in FIG. 6.

Occurrence of such undesirable phenomenon can be effectively prevented in an embodiment illustrated in FIGS. 6 and 7.

Referring now to FIGS. 6 and 7, a guide 38 is fixed onto a cover body member 17 by a supporting plate 39, and a guide 41 is fixed to a lid 20 by an oblique supporting plate 42. Another guide 40 is fixed to a yarn guide plate 19. A yarn spun from a spinning nozzle 6 is bent in a V-figured shape by these guides 38, 41 and 40, and it is then passed through the yarn guide plate 19 and forwarded to nip rollers 7. An air suction tube 15 is disposed at the V-figured bending portion.

A balloon is formed by the yarn-turning action of the spinning nozzle 6 between the spinning nozzle 6 and the guide 38, and large quantities of fly wastes are generated in this balloon-forming area, but they are substantially sucked and removed by an air suction tube 16. However, minor portions of fly wastes that are not sucked by the air suction tube 16 are scattered with the running yarn Y and are caused to fly out over the yarn guide plate 19. In the present embodiment, however, since the yarn Y is bent in a V-figured shape by the guides 38, 41 and 40, every time the running direction of the yarn Y is changed by the bending, fly wastes accompanying the yarn Y are separated from the yarn Y and are readily sucked and removed by the air suction tube 15. Fly wastes being separated from the yarn-bending zone ranging from the guide 38 to the guide 41 fly out along an extension of the yarn Y running from the nozzle 6 toward the guide 38, but they are hindered by the supporting plate 42 and are not allowed to arrive at the yarn guide plate 19 but are sucked and discharged through the suction tube 15. The supporting plate 42 is obliquely disposed so that the above fly wastes can be smoothly introduced into the suction tube 15.

A yarn prepared according to the pneumatic spinning process includes considerable amount of incompletely entangled filaments, and they are readily separated from the yarn to generate fly wastes. In the present embodiment, by bending the yarn in a V-figured shape as pointed out above, these incompletely entangled filaments are positively separated from the yarn and also these filaments are sucked and discharged. Therefore, generation of fly wastes in the subsequent winding zone or at the subsequent treatment step can be remarkably reduced.

Further, by fixing the guide to the lid, the following advantage is attained. Namely, at the time of yarn piecing, by opening the lid 20, hanging the yarn taken out of the spinning nozzle 6 on the guides 38 and 40 and then closing the lid 20, bending of the spun yarn can be accomplished simultaneously, and the yarn-hanging operation can be facilitated.

What is claimed is:

1. A cover means for a pneumatic spinning apparatus comprising a cover having four sides closed and being disposed between a draft zone and nip rollers to cover an entire spinning nozzle zone, and at least one air suction tube connected to the interior of the cover, whereby the air suction tube sucks and removes fly wastes generated from the spinning nozzle zone and is utilized for enhancing the effect of discharging air from the spinning nozzle, said cover comprising a body member and a lid which is connected to the body member by means of a hinge to be freely opened or closed, spinning nozzles are fixed to the body member and said air suction tubes are also connected to the body member.

2. A cover means as set forth in claim 1 wherein said body member and said lid are constructed to have substantially L-shaped section and the spinning nozzles are secured to the side wall of the body member and the air suction tube is opened on the bottom wall of the body member.

3. A cover means as set forth in claim 1 wherein a yarn guide plate having a yarn-passing slit at the front end of the cover is formed integrally with the lid.

4. A cover means as set forth in claim 1 wherein a yarn guide plate having a yarn-passing slit at the front end of the cover is disposed so that it can freely turn and that an opening of the air suction tube is closed thereby when the yarn guide plate opens the cover.

5. A cover means for a pneumatic spinning apparatus comprising a cover having four sides closed and being disposed between a draft zone and nip rollers to cover an entire spinning nozzle zone, at least one air suction tube connected to the interior of the cover whereby the air suction tube sucks and removes fly wastes generated from the spinning nozzle zone and is utilized for enhancing the effect of discharging air from the spinning nozzle, and a plurality of guides for bending the yarn processed from the spinning nozzle disposed in the cover, said air suction tube being opened below the position where the yarn is supported in bending position by the guides.

6. A cover means as set forth in claim 5 wherein said cover comprises a body member and a lid which is connected to the body member to be freely opened or closed, and one of the guides is supported by said lid.

7. A cover means as set forth in claim 6 wherein said guide is fixed to one end of a supporting plate secured to the lower face of the lid at the another end thereof, and said supporting plate is arranged to intercept an extension of a running passage of a yarn spun from the spinning nozzle to maintain the yarn processed therefrom in bending condition.

* * * * *